US006322046B1

(12) United States Patent
Yurick

(10) Patent No.: US 6,322,046 B1
(45) Date of Patent: Nov. 27, 2001

(54) FORM PANEL CLAMP

(76) Inventor: Michael R. Yurick, 995 Ladd Rd., Walled Lake, MI (US) 48390

( * ) Notice: Subject to any disclaimer, the term of this patent is extended or adjusted under 35 U.S.C. 154(b) by 0 days.

(21) Appl. No.: 09/250,681

(22) Filed: Feb. 16, 1999

(51) Int. Cl.[7] ..... E04G 17/00

(52) U.S. Cl. ..... 249/219.1; 249/47; 249/25; 249/33; 248/226.11; 248/228.5

(58) Field of Search ..... 249/219.1, 47, 249/25, 33; 248/226.11, 223.6, 228.5, 231.71, 231.61; 292/305, 253; 24/455

(56) References Cited

U.S. PATENT DOCUMENTS

| | | | | |
|---|---|---|---|---|
| 444,510 | | 1/1891 | Tanner et al. . | |
| 1,300,436 | | 4/1919 | McKay . | |
| 2,037,444 | | 4/1936 | Wales . | |
| 3,131,453 | | 5/1964 | Stockton et al. . | |
| 3,132,405 | * | 5/1964 | Jennings | 25/131 |
| 3,167,842 | | 2/1965 | Pauli, Jr. . | |
| 3,385,556 | | 5/1968 | Pauli, Jr. . | |
| 3,601,356 | | 8/1971 | Yurick . | |
| 3,797,800 | | 3/1974 | Loy . | |
| 4,030,694 | * | 6/1977 | Schimmel | 249/196 |
| 4,776,557 | | 10/1988 | Turner . | |
| 5,044,601 | * | 9/1991 | Miller | 249/194 |
| 5,064,163 | | 11/1991 | Merkel . | |
| 5,078,360 | | 1/1992 | Spera . | |
| 5,234,206 | * | 8/1993 | Shih | 269/231 |
| 5,562,845 | | 10/1996 | Miller et al. . | |
| 5,575,938 | | 11/1996 | Ono . | |
| 5,707,539 | * | 1/1998 | Flathau et al. | 249/189 |
| 5,775,654 | * | 7/1998 | Price | 248/231.61 |

* cited by examiner

*Primary Examiner*—Carl D. Friedman
*Assistant Examiner*—Patrick J. Chavez

(57) ABSTRACT

A concrete form panel clamp includes a threaded rod having a first pin mounted at a first end generally perpendicular to the rod. A second pin spaced away from and generally parallel to the rod is slidably mounted on the rod. A nut threaded onto the rod selectively forces the second pin toward the first pin.

16 Claims, 2 Drawing Sheets

FORM PANEL CLAMP

BACKGROUND OF THE INVENTION

The present invention relates generally to concrete form panels for pouring walls, such as basement walls, and more particularly to a clamping system for such forms.

For pouring concrete walls, such as basement walls, a plurality of inner and outer concrete form panels are mounted around the inner and outer perimeter of the planned wall. Each of the form panels includes a flange extending away from the wall. Each of the flanges include a number of vertically spaced apertures which align with apertures in the flange of the adjacent form panel. Adjacent form panels are secured to each other via pins which are inserted through adjacent pairs of apertures. Each pin includes an elongated slot into which is inserted a wedge.

Usually, flanges on the inner form panels align with flanges on the outer form panels. Wire ties are secured between the flanges of the adjacent inner panels and drawn to the opposite pair of flanges on the outer panels to counteract the weight of the poured concrete and to prevent the inner or outer form panels from bowing out away from the wall. This technique works well for simply shaped basement walls; however, offsets or juts pose a particular problem. Many basement walls for current homes include short offsets in which a section of the wall is offset 8–14 inches. In this case, some of the short form panels utilized in forming the corners and short perpendicular section of the wall cannot be secured with the wire ties, because there is no directly opposite pair of flanges. As a result, large wooden braces are typically constructed to brace both the outer and inner form panels for example, from an eight foot high form panel. The construction of these extra braces is time consuming, and thus expensive.

After the inner and outer form panels are assembled, concrete is poured in between the inner and outer form panels. After the concrete cures, the form panels are disassembled and later reused.

SUMMARY OF THE INVENTION

The present invention provides a concrete form panel clamp which replaces the need for extra braces for offsets in concrete form panels.

Generally, the preferred clamp comprises a first pin mounted perpendicularly to a threaded rod at a first end of the rod. A second pin generally parallel to and spaced away from the rod is mounted to a tube slidably mounted on the rod. The tube is positioned between the first end and a nut threaded onto the rod. A handle extends radially from the nut.

In practice, for both the inner and outer form panels, there is a first form panel which is generally parallel to and laterally offset from a second form panel. A third form panel extends generally perpendicularly to the first and second form panels, joined by an inner corner and outer form panels to the first and second form panels, respectively. Each of the form panels includes a pair of perpendicularly extending flanges. The first pin of the clamp is inserted through adjacent apertures in the first form panel and inner corner form panel. The second pin is inserted through adjacent apertures in the flanges of the third form panel and outer corner form panel. The nut is then tightened to impart force on the tube and second pin toward the first end, thereby clamping the third form panel between the outer and inner corner form panels. The force on the first pin at the flanges of the first form panel and inner corner form panel is transferred via wire ties between the inner and outer form panels. Preferably, a plurality (three or four) clamps are utilized on each of the inner and outer form panels at each offset.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DETAILED DESCRIPTION OF THE PREFERRED EMBODIMENT

Figure 1:
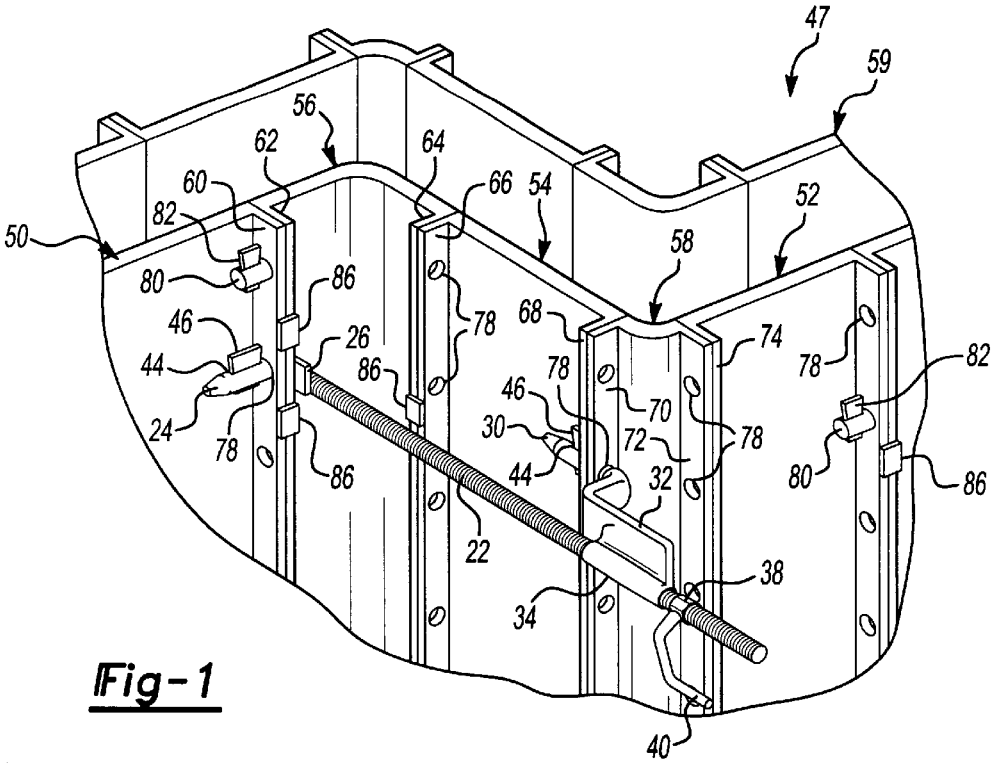
FIG. 1 is a perspective view of the concrete form panel clamp of the present invention.

FIG. 1 illustrates a concrete form panel 20 according to the present invention. The clamp 20 includes an elongated threaded rod 22 which is preferably steel. A first pin 24 is mounted at a first end 26 generally perpendicular to the rod 22. The first pin 24 may be secured to a first bracket 28 which is welded to the first end 26 of the rod 22.

The clamp 20 further includes a second pin 30 generally spaced from, and parallel to, the rod 22. The second pin 30 is preferably mounted to a second bracket 32 which includes a tube 34 slidably mounted on the rod 22.

An internally threaded nut 38 is threaded onto the rod 22 and includes a handle 40 extending radially from the nut 38. The tube 34, bracket 32 and second pin 30 are normally between the nut 38 and first end 26 of the rod 22. Rotation of the nut 38 via the handle 40 selectively forces the second pin 30 toward the first end 26 of the rod 22.

Each of the pins, 24, 30 includes an elongated slot 44 into which a wedge 46 can selectively be inserted. The pins 24, 30 including the slots 44 and wedges 46 are generally similar to those currently utilized for securing concrete form panels.

Figure 2:
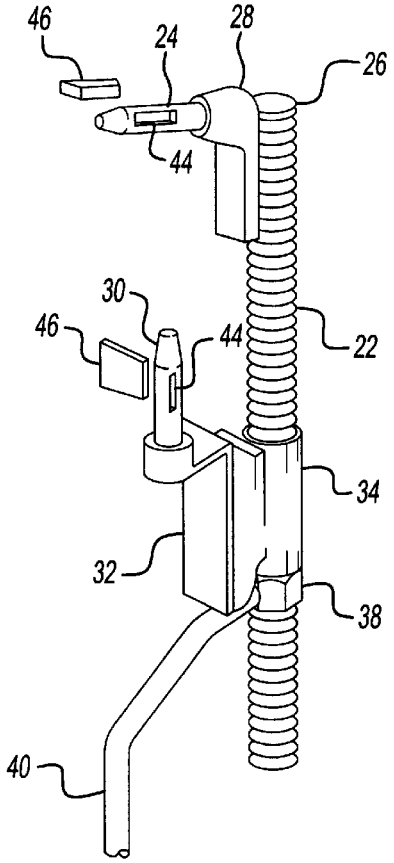
FIG. 2 is a perspective view of the clamp of FIG. 1 installed on a concrete form panel system.

FIG. 2 illustrates a concrete form panel system 47 including a plurality of inner concrete form panels 50, 52, 54, 56, 58 and outer concrete form panels 59 and an offset. The clamp 20 will be described with respect to its use on the inner form panels; however, its use on the outer form panels at the offset would be identical.

The inner form panels include a straight first form panel 50 generally parallel to annularly offset from a straight second form panel 52. A straight third form panel 54 extends generally perpendicularly to the first and second form panels 50, 52. An inner corner form panel 56 joins the first form panel 50 to the third form panel 54. An outer corner form panel 58 joins the third form panel 54 to the second form panel 52. The first form panel 50 includes a flange 60 adjacent a first flange 62 of the inner corner form panel 56. A second flange 64 of the inner corner form panel 56 abuts a flange 66 of the third form panel 54. A second flange 68 of the third form panel 54 abuts a first flange 70 of the outer corner form panel 58. A second flange 72 of the outer corner form panel 58 abuts a flange 74 of the second form panel 52. Each of the flanges includes a plurality of vertically spaced apertures 78. Apertures 78 on adjacent flanges are aligned. Connector pins 80 are inserted through many of the apertures 78 and adjacent flanges and secured with wedges 82.

The first pin 24 of the clamp 20 is inserted through the flange 62 of the inner corner form panel 56 and the flange 60 of the first form panel 50 and secured with a wedge 46. The second pin 30 of the clamp 20 is inserted through the flange 70 of the outer corner form panel 58 and the second flange 68 of the third form panel 54 and secured with a wedge 46. The nut 38 is then tightened via handle 40 to force the second pin 30, the flange 70 and flange 68 toward the first end 26 of the rod 22. Although only one is shown, a plurality of these clamps 20 are preferably utilized spaced below the clamp 20 shown in FIG. 2. A plurality of wire ties 86 are secured between flanges 60, 62, between flanges 64, 66, to opposing pairs of flanges on the outer panels. By forcing the second pin 30 toward the first end 26 of the rod 22, the third form panel 54 is clamped between the outer and inner corner portions 58, 56 preventing the outer corner form panel 58 and third form panel 54 from bowing outwardly from the force of the poured concrete. The force on the second pin 30 toward the first end 26 of the rod 22 is transferred to the nut 38, then to the rod 22, to the first pin 24 through flanges 60, 62 to the wire tie 86 which is secured to an adjacent pair of flanges on the outer panels.

Figure 3:
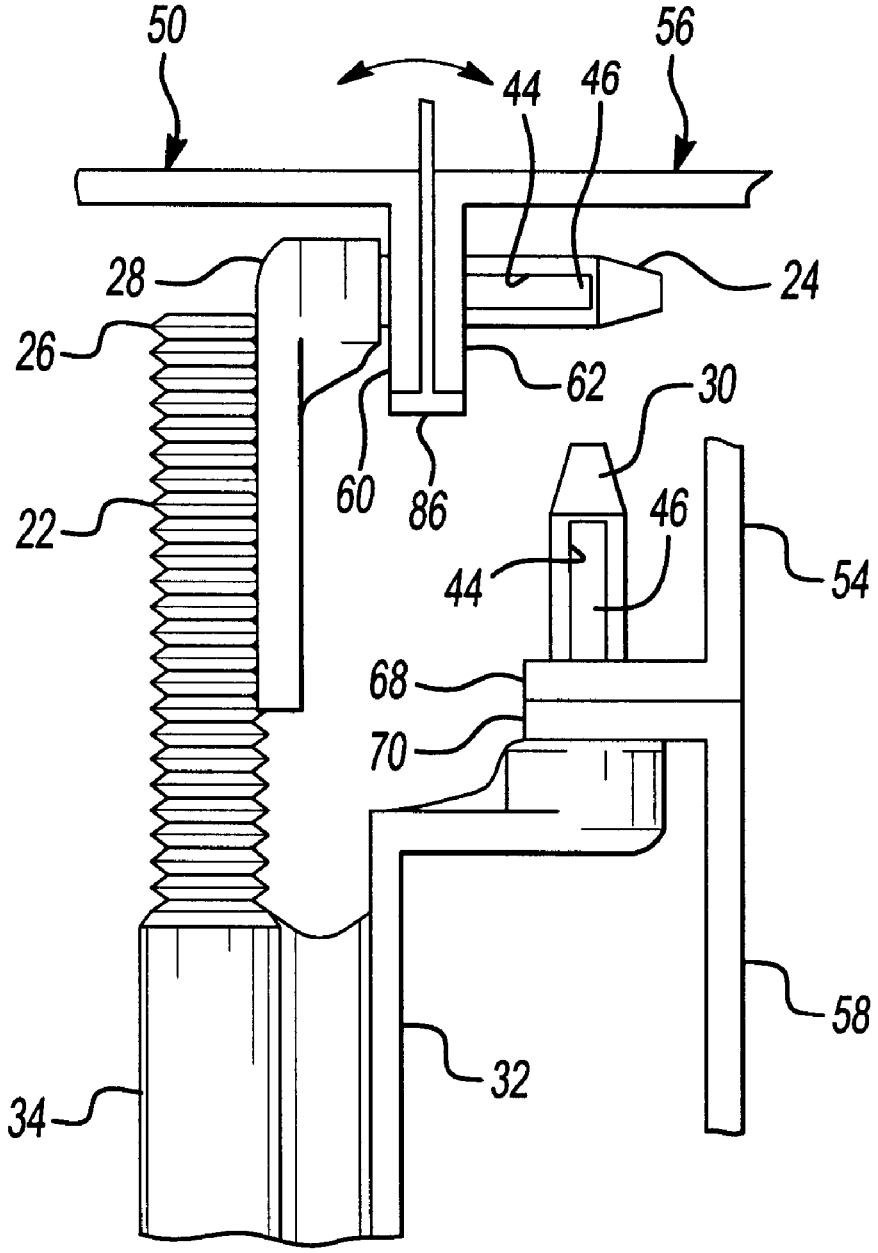
FIG. 3 is a truncated, enlarged plan view of the clamp and form panels of FIG. 2.

FIG. 3 illustrates a truncated view of the clamp 20 from FIG. 2. As can be seen in FIG. 3, the first pin 24 is inserted through the flanges 60, 62 and secured by wedge 46. The wire tie 86 is secured between the flanges 60, 62 and extends inward from the panels 50, 56. The second pin 30 is inserted through the flanges 68, 70 and secured by a wedge 46.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope.

What is claimed is:

1. A concrete form panel clamp comprising:

an elongated rod having a first axial end;

a first pin extending generally perpendicularly to said rod adjacent said first axial end and fixed generally perpendiculary to said rod;

a second pin spaced away from and generally parallel to said rod, said second pin selectably axially movable relative to said rod and selectively securable to said rod at a selected axial position relative to said first end.

2. The clamp of claim 1, wherein said rod is threaded.

3. The clamp of claim 2, further including a nut threaded onto said rod to selectively move said second pin toward said first pin.

4. The clamp of claim 3, wherein each of said pins includes an elongated slot, said clamp further including a wedge disposed in each said slot.

5. The clamp of claim 3, further including a handle extending radially from said nut.

6. The clamp of claim 1, further including a tube slidably mounted on the rod, said second pin mounted on said tube.

7. In combination:

a first form panel;

a second form panel, generally parallel to and laterally offset from said first form panel;

an inner corner form panel abutting said first form panel;

an outer corner form panel abutting said second form panel;

each of said first, inner corner and outer corner form panels including a perpendicularly extending flange, said inner corner and outer corner form panels positioned between the first form panel and second form panel; and a clamp having a first end secured to the flanges of the first and inner corner form panel and a second end secured to the flange of the outer corner form panel, said clamp imparting a force on the flange of the outer corner form panel toward the first end of the clamp.

8. The combination of claim 7, wherein each of the flanges includes at least one aperture, the clamp including a first pin at the first end and a second pin, the first pin disposed in apertures of the first and inner corner form panels, the second pin disposed in an aperture of the outer corner form panel.

9. The combination of claim 8, wherein each of the flanges include the plurality of apertures, the combination further including a plurality of the clamps, each disposed in apertures in the flanges.

10. A method for installing concrete form panels including the steps of:

installing a first form panel;

installing a second form panel, generally parallel to and laterally offset from a first form panel;

installing an inner corner form panel abutting the first form panel and between the first form panel and the second form panel;

installing an outer corner form panel abutting the second form panel and between the inner corner form panel and the second form panel;

securing the outer corner form panel to at least one of the inner corner form panel and the first form panel; and drawing the outer corner form panel toward the inner corner form panel.

11. The method of claim 10 further including the steps of:

securing the first end of a clamp to a flange on the first form panel and a flange on the inner corner form panel;

securing a second end of the clamp to a flange on the outer corner form panel; and drawing the flange of the outer corner form panel toward the first end of the clamp.

12. The method of claim 11 further including the steps of:

inserting a first pin at the first end of the clamp into an aperture in the first form panel and an aperture in the inner corner form panel; and inserting a second pin into an aperture in the outer corner form panel.

13. The method of claim 12 further including the step of threading a nut on the clamp to selectively move the second pin toward the first pin.

14. The concrete form panel clamp of claim 1 wherein the first pin extends from the rod in a first direction and the second pin is spaced away from the rod in a second direction generally opposite the first direction.

15. The concrete form panel clamp of claim 1 wherein the second pin is generally cylindrical.

16. The concrete form panel clamp of claim 1 wherein an outer end of the first pin is generally cylindrical.

* * * * *